US009452103B1

(12) United States Patent
Smallwood

(10) Patent No.: US 9,452,103 B1
(45) Date of Patent: Sep. 27, 2016

(54) BREAST NIPPLE STIMULATION DEVICE AND METHOD

(71) Applicant: Beverly Smallwood, Corona, CA (US)

(72) Inventor: Beverly Smallwood, Corona, CA (US)

( * ) Notice: Subject to any disclaimer, the term of this patent is extended or adjusted under 35 U.S.C. 154(b) by 56 days.

(21) Appl. No.: 14/485,577

(22) Filed: Sep. 12, 2014

Related U.S. Application Data

(63) Continuation-in-part of application No. 13/238,374, filed on Sep. 21, 2011, now abandoned.

(51) Int. Cl.
*A61H 7/00* (2006.01)
*A61H 99/00* (2006.01)

(52) U.S. Cl.
CPC ..... *A61H 7/003* (2013.01); *A61H 99/00* (2013.01)

(58) Field of Classification Search
CPC ..... A61H 7/003; A61H 99/00
See application file for complete search history.

(56) References Cited

U.S. PATENT DOCUMENTS 4,111,192 A 9/1978 Wu
4,628,564 A 12/1986 Youssef
5,871,456 A 2/1999 Armstrong et al.
6,286,173 B1 9/2001 Briones
7,175,502 B2 2/2007 Clark
7,335,183 B2 2/2008 Buiatti
7,549,686 B2 6/2009 Watanabe
2002/0049399 A1 4/2002 Stampf
2013/0180532 A1 7/2013 Montailler

OTHER PUBLICATIONS

Milkyway2010, "Mom says Use a toothbrush on your nipples!", Feb. 10, 2010; http://www.whattoexpect.com/forums/april-201 O-babies/archives/ mo m-says-use-a-toothbrush-on-your -nipple. html.

Babycenter.com, "Are Your Nipples Flat or Inverted?", Oct. 17, 2007; http://web.archive.org/web/20071 018113317 /http://www. babycenter.com/O_are-your-nipples-flat-or-inverted_8789.bc.

*Primary Examiner* — Justine Yu
*Assistant Examiner* — Kathrynn Lyddane

(57) ABSTRACT

A breast nipple stimulation device, for stimulating a breast nipple for nursing features a handle that tapers from a larger diameter to a smaller diameter. The device features a stimulation tip located on a handle first end tip that projects out and away from the handle first end tip. The device features a first handle arch and a second handle arch that are located on a single side of the handle. The second handle arch is larger than the first handle arch.

1 Claim, 2 Drawing Sheets

BREAST NIPPLE STIMULATION DEVICE AND METHOD

CROSS REFERENCE

This application claims priority to U.S. Non-Provisional patent application Ser. No. 13/238,374, filed Sep. 21, 2011 as a continuation-in-part, the specification(s) of which is/are incorporated herein in their entirety by reference.

FIELD OF THE INVENTION

The present invention relates to the field of medical devices, treatment and protocols. A need exists for improving the human breast feeding experience and methodology for mother and child. The prior art for this task contains various devices for poking and prodding the human breast, while the present invention uses a simpler and gentler approach.

BACKGROUND OF THE INVENTION

Description of Related Art pertaining to a breast nipple stimulation device includes as follows:

U.S. Pat. No. 5,871,456, issued to Edie D. Armstrong, on Feb. 16, 1999, entitled Apparatus and Method for Correcting Flat, Inverted or Retracting Nipples of Varying Sizes, discloses a device for correcting flat, inverted or retracting human nipples that primarily uses suction as applied to the breast and areola area.

U.S. Pat. No. 7,335,183, issued to John Bulatti, on Feb. 26, 2008, entitled Nursing Aid System, discloses a nursing aid system that uses a breast cup and a nipple extender. This patent device would encase the breast in a cup and use a nipple extender to reach the nipple for feeding.

U.S. Pat. No. 4,111,192, issued to An-Chuan Wu, on Sep. 5, 1978, entitled Biological Tissue Exercising Device, discloses a biological tissue exercising device. This device uses suction to exercise the front of the breast to stimulate the nipple and to exercise the tissue.

U.S. Pat. No. 7,175,502, issued to Kathrine Clark, on Feb. 13, 2007, entitled Areola Pad, discloses a special areola pad to protect the breast areola and nipple during feeding.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a breast nipple stimulation device, for stimulating a breast nipple for nursing. In some embodiments, the device comprises a handle having a handle first end and a handle second end. In some embodiments, the handle first end comprises a handle first end tip and the handle second end comprises a handle second end tip. In some embodiments, the handle tapers from a larger diameter to a smaller diameter from the handle first end to the handle second end.

In some embodiments, the device comprises a stimulation tip located on the handle first end tip. In some embodiments, the stimulation tip projects out and away from the handle first end tip in a direction opposed to the handle second end tip. In some embodiments, a stimulation tip middle diameter is larger than a handle middle diameter.

In some embodiments, the device comprises a first handle arch having a first handle arch first end and a first handle arch second end. In some embodiments, the first handle arch second end is located on the handle second end close to, but not flush with the handle second end tip. In some embodiments, the first handle arch first end is located on the handle close to the handle second end.

In some embodiments, the device comprises a second handle arch having a second handle arch first end and a second handle arch second end. In some embodiments, the second handle arch second end is located close to the first handle arch first end. In some embodiments, the second handle arch first end is located close to a handle midpoint. In some embodiments, the first handle arch and the second handle arch are located on a single side of the handle.

In some embodiments, the second handle arch is larger than the first handle arch. In some embodiments, a distance between the second handle arch first end and the second handle arch second end is larger than a distance between the first handle arch first end and the first handle arch second end. In some embodiments, a distance between a second handle arch midpoint and the handle is larger than a distance between a first handle arch midpoint and the handle.

DESCRIPTION OF PREFERRED EMBODIMENTS

Figure 1:
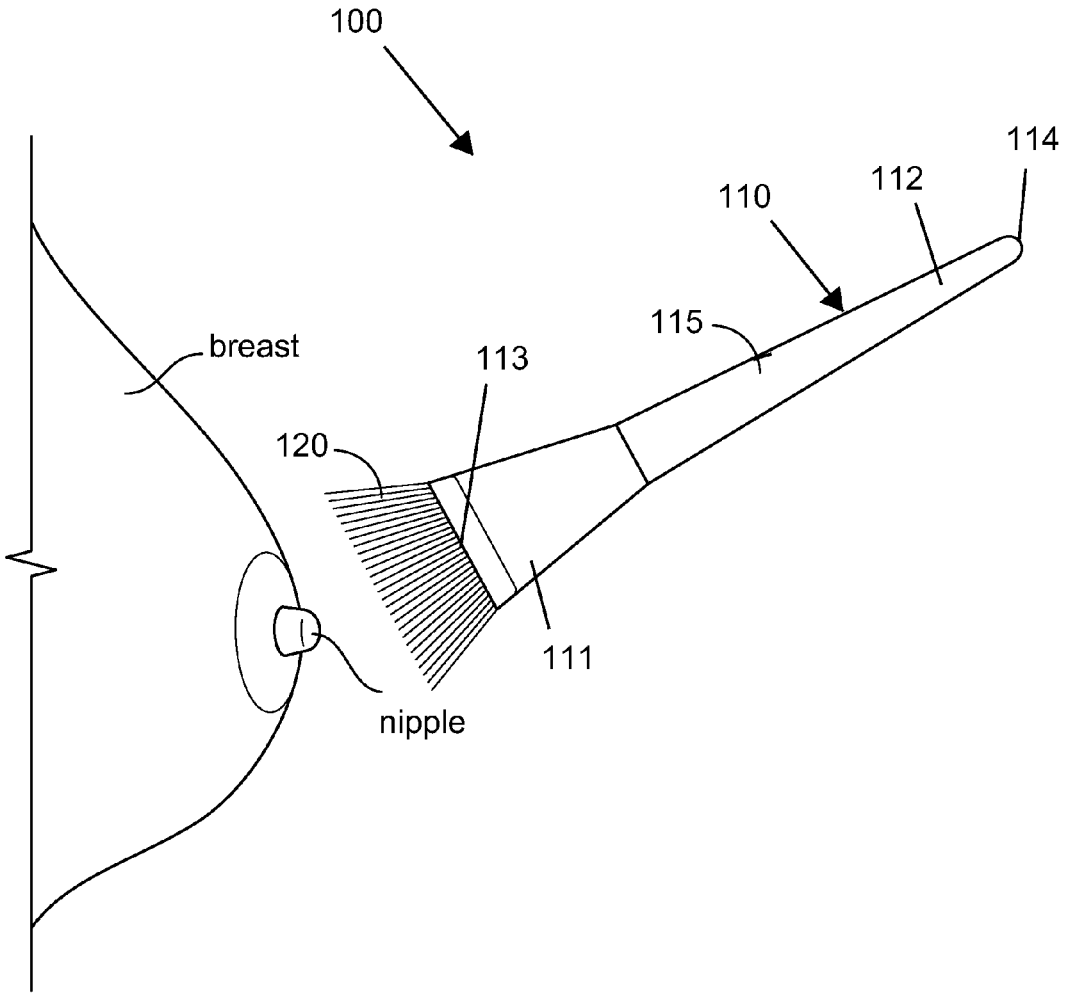
FIG. 1 shows a perspective view of the present invention during use.
Figure 2:
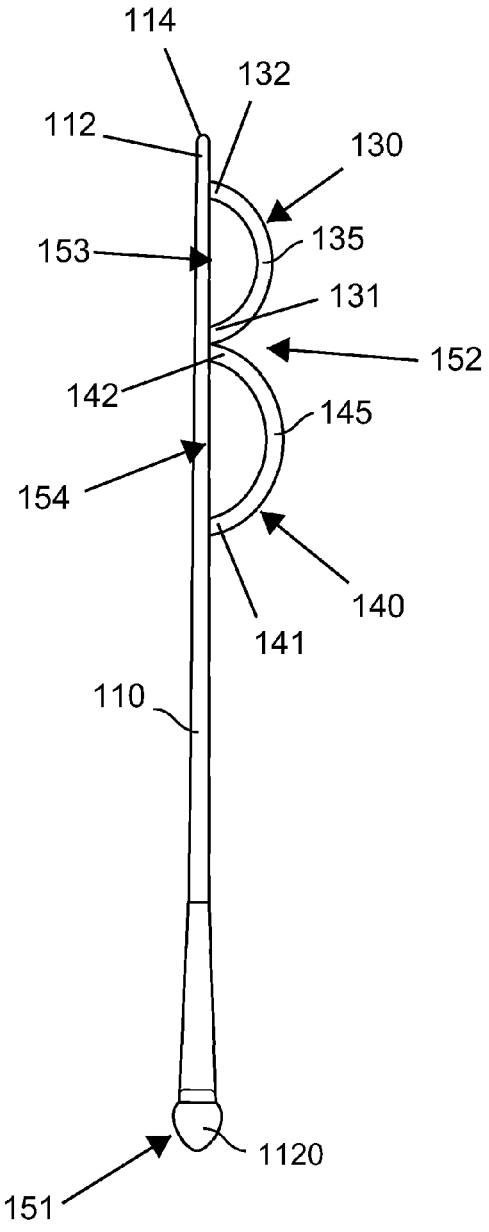
FIG. 2 shows a side view of an embodiment of the present invention featuring a soft, spongy stimulation tip.
Figure 3:
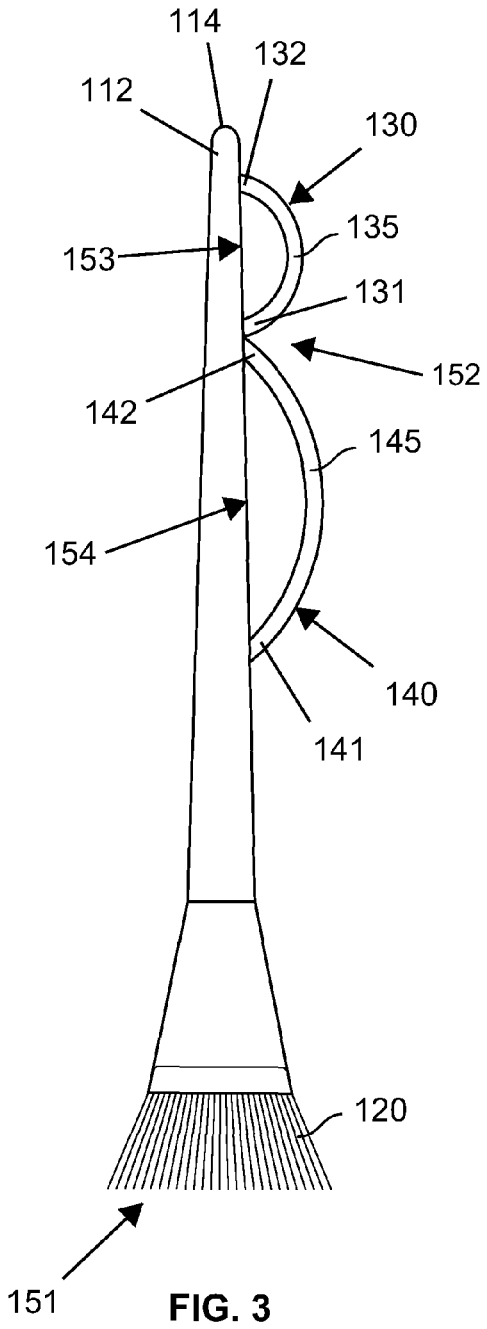
FIG. 3 shows a side view of an embodiment of the present invention featuring soft brush bristles as a stimulation tip.

Following is a list of elements corresponding to a particular element referred to herein:

100 Breast nipple stimulation device
110 Handle
111 Handle first end
112 Handle second end
113 Handle first end tip
114 Handle second end tip
115 Handle midpoint
120 Stimulation tip
130 First handle arch
131 First handle arch first end
132 First handle arch second end
135 First handle arch midpoint
140 Second handle arch
141 Second handle arch first end
142 Second handle arch second end
145 Second handle arch midpoint
151 First stimulation location
152 Second stimulation location
153 Third stimulation location
154 Fourth stimulation location Referring now to FIG. 1-3, the present invention features a breast nipple stimulation device (100), for stimulating a breast nipple for nursing. In some embodiments, the device (100) comprises a handle (110) having a handle first end (111) and a handle second end (112). In some embodiments, the handle first end (111) comprises a handle first end tip (113) and the handle second end (112) comprises a handle second end tip (114). In some embodiments, the handle (110) tapers from a larger diameter to a smaller diameter from the handle first end (111) to the handle second end (112). In some embodiments, the handle (110) is rigid.

In some embodiments, the device (100) comprises a stimulation tip (120) located on the handle first end tip (113). In some embodiments, the stimulation tip (120) projects out and away from the handle first end tip (113) in a direction opposed to the handle second end tip (114). In some embodiments, a stimulation tip middle diameter is larger than a handle middle diameter. In some embodiments, the stimulation tip (120) is tapered. In some embodiments, the stimulation tip (120) is flared. In some embodiments, the stimulation tip is soft, resembling a cosmetic application brush rather than a cleaning brush or a tooth brush.

In some embodiments, the device (100) comprises a first handle arch (130) having a first handle arch first end (131) and a first handle arch second end (132). In some embodiments, the first handle arch second end (132) is located on the handle second end (112) close to, but not flush with the handle second end tip (114). In some embodiments, the first handle arch first end (131) is located on the handle (110) close to the handle second end (112). In some embodiments, the first handle arch (130) and the handle (110) combine to form a first semi-circular opening.

In some embodiments, the device (100) comprises a second handle arch (140) having a second handle arch first end (141) and a second handle arch second end (142). In some embodiments, the second handle arch second end (142) is located close to the first handle arch first end (131). In some embodiments, the second handle arch first end (141) is located close to a handle midpoint (115). In some embodiments, the first handle arch (130) and the second handle arch (140) are located on a single side of the handle (110) In some embodiments, the second handle arch (140) and the handle (110) combine to form a second semi-circular opening.

In some embodiments, the first semi-circular opening and the second semi-circular opening are critical features of the present invention. In some embodiments, the semi-circular shape of the openings allow the nipple to enter the opening, but not protrude through the opening to the extent of allowing the infant to nurse while the device is in position. In some embodiments, the linear handle portion that defines a side of the openings, in conjunction with the handle arch restricts how much of the breast enters the opening, thus restricting the level of projection of the nipple through the opening. In some embodiments, a thickness of the handle and the arch is equal to or greater than a nipple height of the nipple such that the thickness of the handle and the arch prevents the nipple from protruding through an opposing side of the semi-circular opening.

In some embodiments, the second handle arch (140) is larger than the first handle arch (130). In some embodiments, a distance between the second handle arch first end (141) and the second handle arch second end (142) is larger than a distance between the first handle arch first end (131) and the first handle arch second end (132). In some embodiments, a distance between a second handle arch midpoint (145) and the handle (110) is larger than a distance between a first handle arch midpoint (135) and the handle (110).

In some embodiments, the stimulation tip (120) comprises soft bristles. In some embodiments, the soft bristles are natural fiber. In some embodiments, the soft bristles are synthetic fiber. In some embodiments, the soft bristles are hypoallergenic. In some embodiments, the soft bristles resemble the bristles on a paint brush or a cosmetics brush.

In some embodiments, the stimulation tip (120) comprises a sponge. In some embodiments, the sponge is soft. In some embodiments, the sponge is a natural sea sponge. In some embodiments, the sponge is a synthetic sponge. In some embodiments, the sponge is soft and absorbent.

In some embodiments, the device (100) is an aid to be used before nursing, and not during nursing. In some embodiments, the device (100) is to be removed before nursing.

In some embodiments, the method comprises the a step of obtaining a breast nipple stimulation device (100), for stimulating a breast nipple for nursing. In some embodiments, the device (100) comprises a handle (110) having a handle first end (111) and a handle second end (112). In some embodiments, the handle first end (111) comprises a handle first end tip (113) and the handle second end (112) comprises a handle second end tip (114). In some embodiments, the handle (110) tapers from a larger diameter to a smaller diameter from the handle first end (111) to the handle second end (112). In some embodiments, the device (100) comprises a stimulation tip (120) located on the handle first end tip (113). In some embodiments, the stimulation tip (120) projects out and away from the handle first end tip (113) in a direction opposed to the handle second end tip (114). In some embodiments, a stimulation tip middle diameter is larger than a handle middle diameter. In some embodiments, the device (100) comprises a first handle arch (130) having a first handle arch first end (131) and a first handle arch second end (132). In some embodiments, the first handle arch second end (132) is located on the handle second end (112) close to, but not flush with the handle second end tip (114). In some embodiments, the first handle arch first end (131) is located on the handle (110) close to the handle second end (112). In some embodiments, the first handle arch (130) and the handle (110) combine to form a first semi-circular opening. In some embodiments, the device (100) comprises a second handle arch (140) having a second handle arch first end (141) and a second handle arch second end (142). In some embodiments, the second handle arch second end (142) is located close to the first handle arch first end (131). In some embodiments, the second handle arch first end (141) is located close to a handle midpoint (115). In some embodiments, the first handle arch (130) and the second handle arch (140) are located on a single side of the handle (110) In some embodiments, the second handle arch (140) and the handle (110) combine to form a second semi-circular opening. In some embodiments, the second handle arch (140) is larger than the first handle arch (130). In some embodiments, a distance between the second handle arch first end (141) and the second handle arch second end (142) is larger than a distance between the first handle arch first end (131) and the first handle arch second end (132). In some embodiments, a distance between a second handle arch midpoint (145) and the handle (110) is larger than a distance between a first handle arch midpoint (135) and the handle (110).

In some embodiments, the method comprises the remaining steps of placing an index finger within the first semi-circular opening of the first handle arch (130) and wrapping the index finger around the handle (110), placing a middle finger within the second semi-circular opening of the second handle arch (140) and wrapping the middle finger around the handle (110), and via a first location (151) of the breast nipple stimulation device (100), softly stroking the breast and the nipple via the stimulation tip (120) until the nipple responds by becoming erect for proper nursing, or alternately placing a hand over the stimulation tip (120) and wrapping the hand around the handle first end (111), placing an exterior surface of an intersection of the first handle arch (130) and the second handle arch (140) against the breast and the nipple, and via a second location (152) of the breast nipple stimulation device (100), pressing against or into the breast and the nipple while moving upward and downward, side to side, inward and outward, back and forth in a rocking motion, or in a circular rotation until the nipple responds by becoming erect for proper nursing, or alternately placing a hand over the stimulation tip (120) and wrapping the hand around the handle first end (111), placing the first handle arch (130) over a portion of the nipple, and via a third location (153) of the breast nipple stimulation device (100), stroking the portion of the nipple via an interior surface of the first handle arch (130) while moving upward and downward, side to side, inward and outward, back and forth in a rocking motion, or in a circular rotation, wherein the interior surface of the first handle arch (130) is sequentially worked around the nipple in portions until the nipple responds by becoming erect for proper nursing, or alternately placing a hand over the stimulation tip (120) and wrapping the hand around the handle first end (111), placing the second handle arch (140) over a portion of the nipple, and via a fourth location (154) of the breast nipple stimulation device (100), stroking the portion of the nipple via an interior surface of the second handle arch (140) while moving upward and downward, side to side, inward and outward, back and forth in a rocking motion, or in a circular rotation, wherein the interior surface of the second handle arch (140) is sequentially worked around the nipple in portions until the nipple responds by becoming erect for proper nursing.

In some embodiments, the device (100), when used in the second position, the third position, or the fourth position, is pressed into the breast to sculpt the breast and cause an inverted, or a flat nipple to protrude for nursing. In some embodiments, the device (100) is used prior to each time the infant nurses. In some embodiments, the device (100) is used periodically, when needed.

In some embodiments, the first semi-circular opening and the second semi-circular opening are sized such that only a portion of the nipple is inserted therein. In some embodiments, this is a critical feature of the present invention. In some embodiments, the device is used for stroking the portion of the nipple via an interior surface of the either arch while moving upward and downward, side to side, inward and outward, back and forth in a rocking motion, or in a circular rotation, wherein the interior surface of the either arch is sequentially worked around the nipple in portions until the nipple responds by becoming erect for proper nursing.

In some embodiments, the method of stimulating a breast nipple for nursing comprises four stimulation stroke location options using the breast nipple stimulation device (100).

ADDITIONAL DETAILED DESCRIPTION

FIG. 1 shows the invention in which the method uses a brush handle with brush bristles for the tip of the brush handle for human breast nipple stimulation. The invention method is required when the human breast has the nipple either inverted or not prominent enough for proper nursing contact. In this situation, the brush handle with either brush bristles or a handle sponge pad tip (not shown) can be used with soft stroking motions to stimulate the human breast and breast nipple until the nipple responds and becomes erect for proper nursing contact with the baby.

FIG. 2 shows a slender brush handle that has both a brush handle top loop and a brush handle bottom loop affixed to the top portion of the brush handle along with a brush handle sponge tip at the end of the brush handle for use in the invention method for human breast nipple stimulation. In this situation, the brush handle with either brush bristles (not shown) or a handle sponge pad tip can be used with soft stroking motions to stimulate the human breast (not shown) and breast nipple (not shown) until the nipple responds and becomes erect for proper nursing contact with the baby. In addition, the brush handle top loop and a brush handle bottom loop affixed to the top portion of the brush handle, come together to almost join such that the point of joining with the attendant loops can be used to stimulate the breast nipple by stroking the human breast (not shown) with the breast nipple (not shown) between the two loops. The two loops could also be used separately by placing either the brush handle top loop or the brush handle bottom loop over the breast nipple (not shown) for similar stimulation.

FIG. 3 shows a brush handle that has both a brush handle top loop and a elongated brush handle bottom loop affixed to the top portion of the brush handle along with brush handle bristle tip at the end of the brush handle for use in the invention method for human breast nipple stimulation. In this situation, the brush handle with either brush bristles or a handle sponge pad tip (not shown) can be used with soft stroking motions to stimulate the human breast (not shown) and breast nipple (not shown) until the nipple responds and becomes erect for proper nursing contact with the baby. In addition, the brush handle top loop and a brush handle elongated bottom loop affixed to the top portion of the brush handle, come together to almost join such that the point of joining with the attendant loops can be used to stimulate the breast nipple by stroking the human breast (not shown) with the breast nipple (not shown) between the two loops. The two loops could also be used separately by placing either the brush handle top loop or the brush handle elongated bottom loop over the breast nipple (not shown) for similar stimulation.

The present invention is in the field of medical treatment and protocols, specifically, a method for improving the human breast feeding experience and methodology for mother and child. The prior art for this task contains various devices for poking and prodding the human breast, while the present invention uses a simpler and gentler approach.

In FIG. 1, the invention is shown in which the method uses a brush handle with brush bristles for the tip of the brush handle for human breast nipple stimulation. The invention method is required when the human breast has the nipple either inverted or not prominent enough for proper nursing contact. In this situation, the brush handle with either brush bristles or a handle sponge pad tip (1120) (FIG. 2) can be used with soft stroking motions to stimulate the human breast and breast nipple until the nipple responds and becomes erect for proper nursing contact with the baby.

In FIG. 2, the invention is shown as a slender brush handle that has both a brush handle top loop and a brush handle bottom loop affixed to the top portion of the brush handle along with a brush handle sponge tip at the end of the brush handle for use in the invention method for human breast nipple stimulation. In this situation, the brush handle with either brush bristles (FIGS. 1 and 3) or a handle sponge pad tip can be used with soft stroking motions to stimulate the human breast (FIG. 1) and breast nipple (FIG. 1) until the nipple responds and becomes erect for proper nursing contact with the baby. In addition, the brush handle top loop and a brush handle bottom loop affixed to the top portion of the brush handle, come together to almost join such that the point of joining with the attendant loops can be used to stimulate the breast nipple by stroking the human breast (FIG. 1) with the breast nipple (FIG. 1) between the two loops. The two loops could also be used separately by placing either the brush handle top loop or the brush handle bottom loop over the breast nipple (FIG. 1) for similar stimulation.

In FIG. 3, the invention shows a brush handle that has both a brush handle top loop and an elongated brush handle bottom loop affixed to the top portion of the brush handle along with brush handle bristle tip at the end of the brush handle for use in the invention method for human breast nipple stimulation. In this situation, the brush handle with either brush bristles or a handle sponge pad tip (FIG. 2) can be used with soft stroking motions to stimulate the human breast (FIG. 1) and breast nipple (FIG. 1) until the nipple responds and becomes erect for proper nursing contact with the baby. In addition, the brush handle top loop and a brush handle elongated bottom loop affixed to the top portion of the brush handle, come together to almost join such that the point of joining with the attendant loops can be used to stimulate the breast nipple by stroking the human breast (FIG. 1) with the breast nipple (FIG. 1) between the two loops. The two loops could also be used separately by placing either the brush handle top loop or the brush handle elongated bottom loop over the breast nipple (FIG. 1) for similar stimulation. The sponge pad can be used dry, or it can be moistened with water or baby formula. The water or baby formula is used to provide extra stimulation to the human breast and nipple, and also to entice the baby to begin suckling due to the presence of moistness and/or remembered feedings with the presence of the baby formula.

The purpose of the different sizes of the arch loop is to accommodate the different sizes of the nipple. The function of the arch loop is to sculpture the nipple to be in proper state and form for the baby to properly latch on the nipple when they suck milk.

As used herein, the term "about" refers to plus or minus 10% of the referenced number.

The disclosures of the following U.S. Patents are incorporated in their entirety by reference herein: U.S. Pat. No. 7,549,686; U.S. Pat. No. 7,335,183; U.S. Pat. No. 7,175,502; U.S. Pat. No. 6,286,173; U.S. Pat. No. 5,871,456; U.S. Pat. No. 4,628,564; U.S. Pat. No. 4,111,192; U.S. Patent Pub. No 2002/0049399.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method of stimulating a breast nipple for nursing, wherein the method comprises the steps of:

(a) obtaining a breast nipple stimulation device (100), for stimulating a breast nipple for nursing, wherein the device (100) comprises a handle (110) having a handle first end (111) and a handle second end (112), wherein the handle first end (111) comprises a handle first end tip (113) and the handle second end (112) comprises a handle second end tip (114), wherein the handle (110) tapers from a larger diameter to a smaller diameter from the handle first end (111) to the handle second end (112); a stimulation tip (120) is disposed on the handle first end tip (113), wherein a plurality of bristles of the stimulation tip (120) are disposed in a continuous plane along with the handle (110) as opposed to a perpendicular plane, wherein the stimulation tip (120) projects out and away from the handle first end tip (113) in a direction opposed to the handle second end tip (114), wherein a stimulation tip middle diameter is larger than a handle middle diameter; a first handle arch (130) having a first handle arch first end (131) and a first handle arch second end (132), wherein the first handle arch second end (132) is disposed on the handle second end (112) proximal to, but not flush with the handle second end tip (114), wherein the first handle arch first end (131) is disposed on the handle (110) proximal to the handle second end (112), wherein the first handle arch (130) and the handle (110) combine to form a first semi-circular opening; and a second handle arch (140) having a second handle arch first end (141) and a second handle arch second end (142), wherein the second handle arch second end (142) is disposed proximal to the first handle arch first end (131), wherein the second handle arch first end (141) is disposed proximal to a handle midpoint (115), wherein the first handle arch (130) and the second handle arch (140) are disposed on a single side of the handle (110) wherein the second handle arch (140) and the handle (110) combine to form a second semi-circular opening; wherein the second handle arch (140) is larger than the first handle arch (130), wherein a distance between the second handle arch first end (141) and the second handle arch second end (142) is larger than a distance between the first handle arch first end (131) and the first handle arch second end (132), wherein a distance between a second handle arch midpoint (145) and the handle (110) is larger than a distance between a first handle arch midpoint (135) and the handle (110); and (b) placing a hand over the stimulation tip (120) and wrapping the hand around the handle first end (111), placing the first handle arch (130) over a portion of the nipple but not over the entire nipple, and via a third location (153) of the breast nipple stimulation device (100), stroking the portion of the nipple via an interior surface of the first handle arch (130) while moving upward and downward, side to side, inward and outward, back and forth in a rocking motion, or in a circular rotation, wherein the interior surface of the first handle arch (130) is sequentially worked around the nipple in portions until the full nipple responds by becoming erect for proper nursing, wherein the step of obtaining a breast nipple stimulation device comprises selecting a device (100) having a radius of the first semi-circular opening with a dimension smaller than the nipple, wherein the first semi-circular opening is sized such that only a portion of the nipple is inserted therein, wherein a thickness of the handle (110) and the arch (130) prevents the nipple from protruding through an opposing side of the semi-circular opening and there is no way for a baby to suck on the nipple through the first handle arch (130) as the nipple size is bigger than the size of the first semi-circular opening; and (c) removing the device (100) after nipple erection and before nursing.

* * * * *